US011801198B2

(12) United States Patent
Bosomworth et al.

(10) Patent No.: US 11,801,198 B2
(45) Date of Patent: Oct. 31, 2023

(54) ICE BATH

(71) Applicant: Brass Monkey Health LTD, West Yorkshire (GB)

(72) Inventors: Danyl Lee Bosomworth, West Yorkshire (GB); Dale Mark Bosomworth, West Yorkshire (GB); Robert Wray, West Yorkshire (GB)

(73) Assignee: Brass Monkey Health LTD, West Yorkshire (GB)

( * ) Notice: Subject to any disclaimer, the term of this patent is extended or adjusted under 35 U.S.C. 154(b) by 0 days.

(21) Appl. No.: 18/054,697

(22) Filed: Nov. 11, 2022

(65) Prior Publication Data

US 2023/0293386 A1 Sep. 21, 2023

(51) Int. Cl.
*A61H 33/00* (2006.01)

(52) U.S. Cl.
CPC . *A61H 33/0095* (2013.01); *A61H 2201/0207* (2013.01); *A61H 2201/0214* (2013.01); *A61H 2201/5058* (2013.01); *A61H 2201/5082* (2013.01); *A61H 2201/5097* (2013.01); *A61H 2203/02* (2013.01)

(58) Field of Classification Search
CPC ..... A61H 33/0095
USPC ..... 4/454, 538
See application file for complete search history.

(56) References Cited

U.S. PATENT DOCUMENTS

| | | | | |
|---|---|---|---|---|
| 3,776,223 | A * | 12/1973 | Yeager | A61G 7/1003 4/560.1 |
| 4,099,522 | A * | 7/1978 | Alenares | A61H 35/006 607/82 |
| 4,214,576 | A * | 7/1980 | Henley | A61H 33/04 601/16 |
| 4,346,485 | A * | 8/1982 | Reed | A47K 3/022 4/601 |
| 5,903,934 | A * | 5/1999 | Sears, III | A47K 3/00 4/546 |
| 7,029,452 | B1 * | 4/2006 | Alton, Jr. | A61H 33/00 601/55 |
| 7,112,768 | B2 * | 9/2006 | Brochu | A61H 33/0095 392/471 |
| 8,216,291 | B1 * | 7/2012 | Leventhal | A61H 35/00 607/104 |
| 8,393,019 | B1 * | 3/2013 | Cavuoti | A61H 33/0095 4/546 |
| 10,617,601 | B1 * | 4/2020 | Wilkinson | A61H 35/008 |
| 11,583,472 | B1 * | 2/2023 | Myers-Ramsay | A61H 33/026 |
| 2008/0039753 | A1 * | 2/2008 | Zomorodian | A61H 35/00 601/148 |

(Continued)

FOREIGN PATENT DOCUMENTS

| | | | | |
|---|---|---|---|---|
| EP | 1559391 | A2 * | 8/2005 | A61H 33/0095 |
| GB | 2568452 | A | 5/2019 | |

(Continued)

*Primary Examiner* — Lori L Baker
(74) *Attorney, Agent, or Firm* — Renner, Otto, Boisselle & Sklar, LLP

(57) ABSTRACT

An ice bath having a receptacle section and a temperature control element adjacent thereto and arranged to adjust the temperature of the receptable section. The temperature control element is connected to a refrigeration module that reduces the temperature of the receptacle. The temperature control element is further connected to a heating module that increases the temperature of the receptacle.

14 Claims, 1 Drawing Sheet

(56) References Cited

U.S. PATENT DOCUMENTS

| | | | | |
|---|---|---|---|---|
| 2013/0327134 | A1* | 12/2013 | Johnson | G01K 13/00 73/118.03 |
| 2015/0144206 | A1 | 5/2015 | Dickinson et al. | |
| 2017/0224583 | A1* | 8/2017 | Authier | F24S 20/02 |
| 2019/0070070 | A1* | 3/2019 | Mulcahy | A61H 33/60 |
| 2020/0000628 | A1* | 1/2020 | Lowe | A61F 7/0085 |
| 2020/0009013 | A1* | 1/2020 | Authier | A61H 33/005 |

FOREIGN PATENT DOCUMENTS

| | | | | |
|---|---|---|---|---|
| KR | 2020090006175 | | 6/2009 | |
| WO | WO-2010068797 | A1 * | 6/2010 | A43B 3/0005 |

* cited by examiner

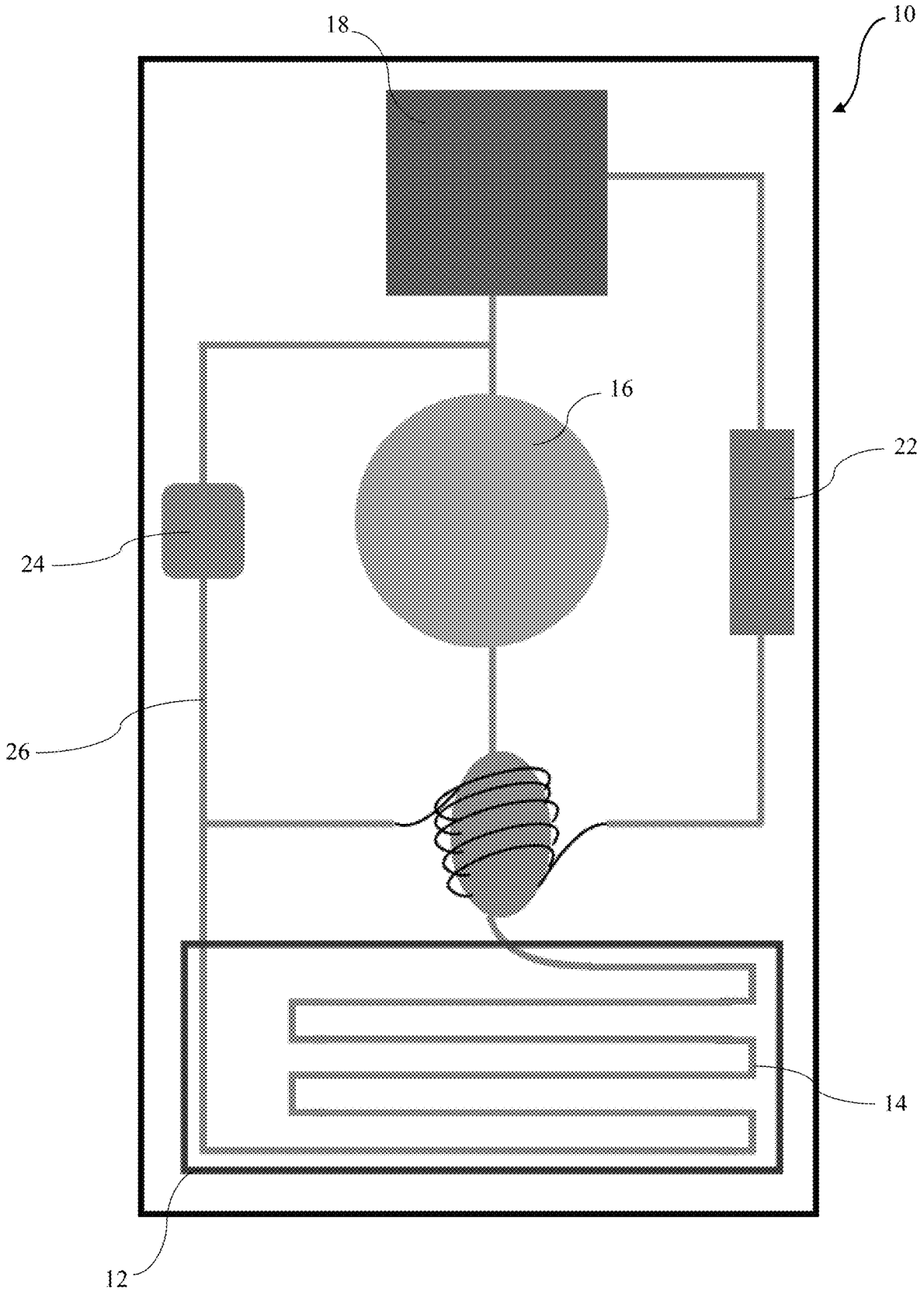
10
18
16
22
24
26
14
12

ICE BATH

This application claims the benefit of GB2203791.5 filed on Mar. 18, 2021. Which is herein incorporated by reference in its entirety.

FIELD OF THE INVENTION

The invention relates to an immersion therapy ice bath for a human or animal and a method of operating the same.

BACKGROUND TO THE INVENTION

Cold water immersion, in which a person is immersed in cold water, is becoming increasingly popular, particularly with people that have undertaken sporting activity. Some studies have suggested that cold water immersion and the use of ice baths improves health and sporting performance.

Ice baths, which are used in cold water immersion, exist in various forms, including bins or plastics material containers filled with ice and water; however, there is a growing need for purpose-built ice baths, which are baths or tubs that are specifically designed for cold water immersion. Such ice baths normally comprise a larger receptacle region that is filled with water and ice. In recent times, such devices have been designed to incorporate a refrigeration unit to cool the water held therein and there are some devices in which the water receptacle of the ice bath is chilled to a temperature where ice forms on the inside of the receptacle.

In ice baths with refrigeration units therein, oftentimes, prior to using the ice bath, the user must turn off the refrigeration system in good time before they wish to enter the ice bath. This allows any ice that has formed inside the receptacle section to defrost and detach from the internal surface of the receptacle. If the user does not turn off the unit in good time, there are safety concerns in respect of the user sitting on a layer of ice. When the ice has detached and floats to the surface of the water, it often needs to be broken up, which is undertaken by hitting the ice with a tool. This manual process can be dangerous, particularly in respect of ice chips coming off the block of ice when struck with a sharp implement. Additionally, striking the ice increases the risk of damage to the ice bath itself.

SUMMARY OF THE INVENTION

Accordingly, the present invention is directed to an ice bath having a receptacle section and a temperature control element adjacent thereto and arranged to adjust the temperature of the receptable section, wherein, the temperature control element is connected to:

- a refrigeration module that reduces the temperature of the receptacle; and
- a heating module that increases the temperature of the receptacle.

Thus, the present invention provides an ice bath that has a receptable that can be chilled by the refrigeration unit. The refrigeration unit is arranged to cool the receptacle and to create ice on an internal surface of the receptacle. Once a layer of ice has been created on the internal surface of the receptacle, the heating module can be employed to raise the temperature of the same surface of the receptacle to a degree at which the ice detaches from the internal surface. As a result, the ice will float to the surface of the ice bath. The use of the heating module allows for the ice to be released at a particular time or thickness. Ideally, the heating module will quickly release the ice from the surface of the receptacle, without significantly increasing the temperature of the water. Thus, the heat from the heating module can be relatively high to effect a quick release of the ice, after which it can be turned off again.

The temperature control element is, preferably, a single element that can be used to both cool and heat the receptacle, for example a fluid-containing conduit. Alternatively, it may be in the form of two or more elements in which one of the elements is used to cool the receptacle and another is used to warm the receptacle. For example, a thermoelectric cooling module may be used for cooling the receptacle and a heater element, which may be electric may be used for heating the receptacle. It will be appreciated that the use of electrical components may be disadvantageous in an ice bath where water and condensation may be present. The temperature control element, in one arrangement, may be an evaporator for use in a refrigeration process.

It will be appreciated that "heat", "cold" and similar words herein are used as relative terms. Thus, "heat" and "cold" are relative to the temperature of the water inside the ice bath and/or the temperature of the receptacle wall. As such, whilst "heat" may flow to the receptacle wall through the temperature control element, it may be that the flow is only a degree or two warmer than the temperature of the receptacle wall or relative to the water within the receptacle. In some arrangements, it may be desirable to have the warm flow at a temperature significantly more than the temperature of the water and/or receptacle.

In an advantageous arrangement, a valve is connected to the temperature control element and the valve is further connected to both:

- the refrigeration module; and
- the heating module, wherein the heating module comprises a heat storage unit; and
- wherein, in a first state, the valve allows the movement of heat away from the temperature control element to decrease the temperature of the receptacle section; and, in a second state, the valve allows the movement of heat from the heat storage unit into the temperature control element to increase the temperature of the receptable section.

The heat storage unit is, preferably, the condenser that can be used as part of the refrigeration process. In such an arrangement, rather than having a separate heat storage unit, heat is accumulated in the condenser, which would normally be provided with heat from the refrigeration process. The heat can be retained within the condenser, or the heat therefrom can be used to heat a separate vessel via a heat exchanger. The heat stored can then be used in the second state by drawing the heat down from the condenser via the valve.

In a particularly advantageous embodiment, when the ice bath is in its first state, heat passes from the temperature control module to the heat storage unit. The heating module may be in the form of a heat storage unit and, as the receptacle is chilled by the refrigeration module, the heat that is generated during the first state in chilling the water, through a refrigeration process, may be stored in the heat storage unit. Thus, the heat removed from the system can be directed into the heat storage unit for use later on, thereby making the arrangement more efficient than having a separate heating element. When the ice layer is at the desired thickness, the heat in the heat storage unit can be used to warm the receptacle in order to detach the ice layer. Again, "heat storage" reflects the relative temperature differences of the receptacle and/or water and the movement of warmer gas, liquid or conducted warmth, which may only be slightly warmer.

In an alternative arrangement, ambient air may be taken into the heat storage unit. Thus, whilst it is preferred that the heat storage unit receives heat from the refrigeration process, heat may be obtained from another source.

The heat storage unit may be provided with uplift means, which is means for heating the fluid therein. Whilst it is envisaged that the heat stored within the heat storage unit should be of a sufficient temperature to release the ice from the receptacle wall, there may be circumstances in which the fluid therein would benefit from being heated further before discharge. Therefore, a warming element can be provided to heat fluid within the heat storage unit. A heat exchanger may be used to warm fluid in the heat storage unit.

The ice bath may further have a third state in which the temperature control element is neither cooled nor heating. This may be a dormant state in which the ice bath can be in a neutral mode and the water, and any ice therein, is left without heating or cooling.

In a preferred arrangement, the valve is a solenoid valve. The use of a solenoid valve provides a quick and reliable switching between the two states of the ice bath. Furthermore, a default safety position can be established so that should there be a power failure, the device can be placed into a default state, which is, preferably, the second state, but could be the first state to keep the water in the ice bath cool for as long as possible. Whilst a mechanical valve may be employed, a solenoid valve provides a quick and efficient response to the changing states of the ice bath.

Advantageously, the temperature control element comprises a conduit through which fluid passes. The use of a fluid conduit allows a reliable heating a cooling conduit through which liquid or gas can pass to heat and cool the receptacle. In one arrangement, copper pipe is employed and is connected to the valve so that the refrigeration unit can readily cool the receptacle using fluid. Similarly, fluid can be stored in the heat storage unit and that can flow through the valve and into the fluid conduit, when required. Clearly, other materials may be used for the cooling conduit, for example, other metals or thermally conductive materials.

It is preferable that the conduit is arranged in a predefined manner, for example, with a plurality of substantially parallel sections. By having a predefined and known shape of the conduit, the cooling of the receptacle can be undertaken in a way in which ice is formed in a known manner. Thus, a particular shape of ice sheet can be formed.

It is beneficial that a central processing unit is provided to control the ice bath and the state thereof, and, preferably, sensors are provided, and those sensors provide feedback to the central processing unit. The use of a central processing unit, or "CPU", allows the ice bath to be controlled automatically. Thus, the central processing unit can be used to monitor various parameters that can be detected by the sensors, for example, the sensors can monitor at least one parameter from a group comprising: ambient air temperature; water temperature; and ambient humidity. The information received from the sensors can be used to determine a temperature to which the receptacle, and optionally the water, can be chilled. Similarly, the sensors and CPU can be used to determine a time for which the ice bath should be in the first state and a time for which the ice bath should be in the second state. Therefore, it is useful that the ice bath is also provided with a timing module. The ice bath can be put into the first state for a known period of time and then either switched to the second state or put into a dormant state.

In one embodiment, a wireless transmitter and/or a wireless receiver is provided. This allows the ice bath to be controlled and updated remotely and/or for information from the ice bath, for example the parameters detected by any sensors, to be received. This allows the ice bath to be adapted for changes to the way in which the device operates and for updating of system software. The transmitted and/or receiver can send and receive information relating to the control of the ice bath.

The invention extends to a method of operating an ice bath, wherein the method comprises the steps of:

a) having liquid within the receptacle of the ice bath;
b) placing the ice bath into the first state and chilling the receptacle for a predetermined chilling time to create a layer of ice on an internal surface of the receptacle; and
c) placing the ice bath into the second state and heating the receptable for a predetermined heating time to release the layer of ice from the internal surface of the receptacle.

A method of operating the ice bath includes the steps of filling the ice bath with water and then it is operating it according to further steps. Such operation includes placing the bath into the first state so that the receptacle is chilled to create ice. Ideally, the heat from the refrigeration process is stored and then it can be re-used when the ice bath is placed into the second state. When the ice bath is in its first state a layer of ice is created on the internal surface of the receptacle of the ice bath. Upon the ice reaching a certain thickness, which can be calculated either through sensors or through a method of determining the time elapsed since the ice bath was placed into the first state, the layer of ice can be detached from the receptacle wall by placing the ice bath into the second state. The ice is then free to float to the surface of the water. A third state may be provided in which the ice bath is neither in the first state or the second state. The third state may be a rest state in which the receptacle is not provided with further chilling, and it is not heated, but instead it is left dormant.

The time in which the ice bath is placed into the first state and the second state is determined by, inter alia, the volume of the receptacle and the amount of water therein. Larger volumes of water may require a long chilling time in the first state.

It is preferable that the ice is created with a waveform profile on at least one surface and wherein the thickness of the ice on a narrow part of the waveform may be a maximum of up to 50 mm. Thus, at least one surface of the ice layer has a sinusoidal, or corrugated, profile. The thickest section is, preferably, less than 30 mm, and the thinnest section is less than that. The corrugated profile allows the ice easier to break into smaller pieces through natural flow and currents within the water. The profile may be created by way of chilling elements, or conduits, being placed in a particular pattern or configuration. The pattern may comprise substantially parallel chilling elements or concentric chilling elements to create a layer of ice that has a particular profile.

Preferably, a central processing unit is provided, and sensors are provided that feed into the central processing unit, wherein the sensors monitor at least one variable parameter, and the processor adjusts at least one of the predetermined chilling time of the first state and the predetermined heating time of the second state.

BRIEF DESCRIPTION OF THE DRAWINGS

An embodiment of the invention will now be described, by way of example only, and with reference to the accompanying drawing, in which:

FIG. 1 shows a schematic diagram of an ice bath accordance with the present invention.

DETAILED DESCRIPTION OF EXEMPLARY EMBODIMENTS

FIG. 1 shows an ice bath 10, in which a receptacle 12 is provided with a temperature control element in the form of copper pipework 14, which is in physical contact with the receptacle. This may be undertaken by applying a layer of thermal mastic around the pipework 14 and the receptacle 12 to ensure a good contact. No gaps should be present in and around the pipework 14 in order to reduce the risk of the condensation formation; instead, the pipework 14 should be sealed adjacent the receptacle 12.

The copper pipework 14 is connected to a refrigeration system, including a suction line header 16, which is in fluid communication with a compressor 18 and, in turn to a condenser 20. The condenser 20 in fluid communication with the pipework 14 via a filter dryer 22, which reduces the risk of water and solids entering into the system.

The condenser 20 has a secondary connection to the pipework 14 via a solenoid valve 24. This bypass conduit 26 allows fluid within the condenser 20 to be directed into the pipework 14 without passing through the filter dryer 22. The system is primed with a coolant. Thus, coolant fluid can pass from the condenser 20 to the pipework 14 via the filter dyer 22 or via the solenoid valve 24.

A central processing unit (not shown) is employed to control the ice bath. The central processing unit can be connected to a timing module and sensors may be provided to give feedback to the central processing unit.

In operation, the ice bath is placed into a first, chilling, state in which the compressor 18 is used to draw heat from the pipework 14, thereby reducing the temperature of the water in the receptacle. As per a refrigeration arrangement, coolant passes from the pipework 14 into the compressor 16 and is compressed to elevate its temperature. The compressed coolant passes from the compressor 18 to the condenser 20; however, whilst some of the heat from the condenser 20 may be dispersed into the atmosphere, at least part of the heat is stored in the condenser 20, or elsewhere, which operates as a heat storage unit.

When the first state has been maintained for a predetermined period, which may be a set period of time or it may be based upon a temperature threshold of the water, a layer of ice is formed on the internal surface of the receptacle 12. When the ice is of a desired thickness, the first state is ended, and the ice bath is placed into either a dormant state or a second state.

In the second state, the solenoid valve 24 is opened, which allows the flow of heat to pass from the condenser 20 into the pipework 14. As a result, the pipework 14 increases in temperature and the surface of the receptable 12 adjacent the pipework 14 is warmed. Where coolant fluid passes from the condenser 20 to the pipework 14 via the solenoid vale 24, the coolant fluid will have an elevated temperature, which is to say that it will have a temperature that is higher than that of the ice and, preferably, the temperature will be considerably higher in order to rapidly release the ice layer from the receptacle surface without heating the water significantly. This fluid effectively defrosts the surface of the receptacle 12 and the ice layer that has been created within the receptacle 12 is released from the surface and it floats to the top of the water contained within the receptacle 12. The ice bath 10 is kept in the second state for a pre-determined period, which may be time dependent, or it may be based upon information received from the sensors, for example, the temperature of the water within the receptacle 12, or the temperature of the receptacle surface that is adjacent the pipework 14. When the second state ends, the ice bath 10 may be placed into a dormant state or it may enter back into the first state.

In the dormant state, the compressor 18 is dormant and the solenoid valve 24 remains closed. Thus, no heating or cooling of the pipework 14 is undertaken by the system, although it will be appreciated that natural heating of the system may occur due to conduction of atmospheric heat.

Due to the shape of the pipework 14, the ice layer may have a corrugated shape and, where this is the case, the ice can readily break up within the water, either due to turbulence within the water or as the narrower part of the ice melt quicker than the thicker parts. Thus, shards of ice are created that assist with keeping the water in the receptacle cold and suitable for cold water immersion.

Heat from the compressor is stored, rather than being dispersed. Thus, when the ice bath goes into the second, warming state to defrost the ice layer from the receptacle, the heat from the compressor is used. To this end, in a preferred embodiment, the condenser 20 receives superheated vapour from the compressor 18, which is fluid at high temperature and high pressure. The condenser 20 retains at least some of the heat from the superheated vapour so that it can be dispersed back into the pipework 14 to run the second state, which may be considered the defrost state. A fan can be provided to reduce the risk of the condenser 20 overheating and to disperse excess heat that may be accumulated.

It will be appreciated that a lid may be provided to the ice bath to assist with insulating the receptacle.

The receptacle is, preferably, a thermally conductive material, such as metal, to ensure that the temperature control element is able to readily affect the water temperature, either drawing heat therefrom or passing heat therein.

What is claimed is:

1. An immersion therapy ice bath for a human having:

a receptacle section with an internal surface and a temperature control element adjacent thereto and arranged to adjust the temperature of the internal surface of the receptable section, wherein, the temperature control element is connected to:

a refrigeration module that reduces the temperature of the internal surface of the receptacle; and a heating module that increases the temperature of the internal surface of the receptacle.

2. An ice bath according to claim 1, wherein a valve is connected to the temperature control element and the valve is further connected to both:

the refrigeration module; and the heating module, wherein the heating module is a heat storage unit; and wherein, in a first state, the valve allows the movement of heat away from the temperature control element to decrease the temperature of the receptacle section; and, in a second state, the valve allows the movement of heat from the heat storage unit into the temperature control element to increase the temperature of the receptacle section.

3. An ice bath according to claim 1, wherein the valve is a solenoid valve.

4. An ice bath according to claim 1, wherein the temperature control element comprises a conduit through which fluid passes.

5. An ice bath according to claim 1, wherein a central processing unit is provided to control the ice bath and the state thereof.

6. An ice bath according to claim 5, wherein sensors are provided, and those sensors provide feedback to the central processing unit.

7. An ice bath according to claim 6, wherein the sensors monitor at least one parameter from a group comprising: ambient air temperature; water temperature; and ambient humidity.

8. An ice bath according to claim 1, wherein a timing module is provided.

9. An ice bath according to claim 1, wherein, when the ice bath is in its first state, heat passes from the temperature control module to the heat storage.

10. An ice bath according to claim 1, wherein a wireless transmitter and wireless receiver is provided that can send and receive information relating to the control of the ice bath.

11. A method of operating an immersion therapy ice bath for a human according to claim 1, wherein the method comprises the steps of:

a) having liquid within the receptacle of the ice bath;

b) placing the ice bath into the first state and chilling the receptacle for a predetermined chilling time to create a layer of ice on an internal surface of the receptacle; and c) placing the ice bath into the second state and heating the receptable for a predetermined heating time to release the layer of ice from the internal surface of the receptacle.

12. A method according to claim 11, wherein, when the ice is released, the ice is created with a waveform profile on at least one surface and wherein the thickness of the ice of the waveform is a maximum of 30 mm.

13. A method according to claim 11, wherein a central processing unit is provided, and sensors are provided, wherein the sensors monitor at least one variable parameter and the processor adjusts at least one of the predetermined chilling time and the predetermined heating time.

14. An ice bath according to claim 1, wherein the temperature control element is configured to control:

the refrigeration module, such that ice forms on the inner wall of the receptacle; and the heating module, such that the formed ice is released from the internal surface of the receptacle.

* * * * *